US009915264B2

(12) United States Patent
Wallenfels

(10) Patent No.: US 9,915,264 B2
(45) Date of Patent: Mar. 13, 2018

(54) INTERMITTENT COUPLING OILING

(71) Applicant: Magna Powertrain Bad Homburg GmbH, Bad Homburg (DE)

(72) Inventor: Joerg Wallenfels, Plettenberg (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 52 days.

(21) Appl. No.: 14/427,422

(22) PCT Filed: Sep. 17, 2013

(86) PCT No.: PCT/DE2013/100332
§ 371 (c)(1),
(2) Date: Mar. 11, 2015

(87) PCT Pub. No.: WO2014/063681
PCT Pub. Date: May 1, 2014

(65) Prior Publication Data

US 2015/0240816 A1 Aug. 27, 2015

(30) Foreign Application Priority Data

Oct. 22, 2012 (DE) ..... 10 2012 110 038

(51) Int. Cl.
*F03C 2/00* (2006.01)
*F03C 4/00* (2006.01)
(Continued)

(52) U.S. Cl.
CPC ..... *F04C 29/02* (2013.01); *F01M 9/108* (2013.01); *F04C 18/322* (2013.01);
(Continued)

(58) Field of Classification Search
CPC ..... F04C 29/02; F04C 18/322; F04C 18/344; F04C 25/02; F04C 29/005; F04C 29/0085; F04C 29/023; F04C 29/028; F01M 9/108
(Continued)

(56) References Cited

U.S. PATENT DOCUMENTS

| | | | |
|---|---|---|---|
| 4,478,562 | A | 10/1984 | Schippers et al. |
| 2012/0076682 | A1 | 3/2012 | Sakakibara et al. |
| 2012/0156076 | A1 | 6/2012 | Sakakibara et al. |

FOREIGN PATENT DOCUMENTS

| | | | |
|---|---|---|---|
| CN | 102177319 | A | 9/2011 |
| EP | 1850007 | A1 | 10/2007 |

(Continued)

OTHER PUBLICATIONS

Search Report dated Aug. 9, 2016 from the State Intellectual Property Office in corresponding Chinese Patent Application No. 201380055250.9.

(Continued)

*Primary Examiner* — Theresa Trieu
(74) *Attorney, Agent, or Firm* — Dickinson Wright PLLC

(57) ABSTRACT

A pump, particularly a vacuum pump for boosting braking power on a motor vehicle, including a housing, a rotor mounted in the housing so as to be rotatable, an oil riser groove arranged in the housing in the area of the rotor mounting, and a transverse bore arranged in the rotor transverse to the longitudinal axis of the rotor and which can be connected to the oil riser groove. The rotor mounting area is connected to an oil supply bore. The transverse bore interacts with an axial bore in the rotor which leads to a coupling section within the rotor, in which a coupling is
(Continued)

Figure 1:
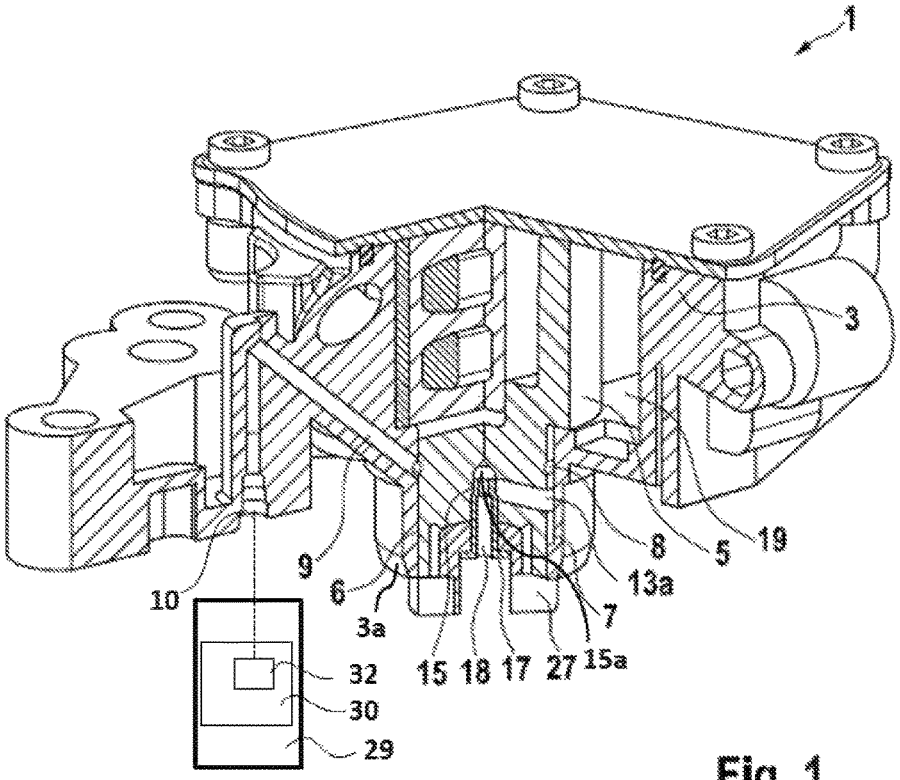

arranged which can be engaged by a fastener having a central bore running parallel to the longitudinal axis of the rotor.

16 Claims, 3 Drawing Sheets

(51) Int. Cl.

| | |
|---|---|
| ***F04C 2/00*** | (2006.01) |
| ***F04C 29/02*** | (2006.01) |
| ***F04C 25/02*** | (2006.01) |
| ***F04C 29/00*** | (2006.01) |
| ***F04C 18/344*** | (2006.01) |
| ***F01M 9/10*** | (2006.01) |
| ***F04C 18/32*** | (2006.01) |

(52) U.S. Cl.
CPC ..... *F04C 18/344* (2013.01); *F04C 25/02* (2013.01); *F04C 29/005* (2013.01); *F04C 29/0085* (2013.01); *F04C 29/023* (2013.01); *F04C 29/028* (2013.01)

(58) Field of Classification Search
USPC ..... 418/88, 94, 206.1–206.9, 259
See application file for complete search history.

(56) References Cited

FOREIGN PATENT DOCUMENTS

| | | | |
|---|---|---|---|
| EP | 2397696 | A1 | 11/2010 |
| JP | 1162864 | A | 3/1999 |
| JP | 2009185699 | A | 8/2009 |

OTHER PUBLICATIONS

International Search Report dated Jan. 27, 2014.

INTERMITTENT COUPLING OILING

CROSS-REFERENCE TO RELATED APPLICATION

This application is a U.S. National Stage of International Application No. PCT/DE2013/100332 filed Sep. 17, 2013 which claims the benefit of and priority to German Application No. 10 2012 110 038.1 filed Oct. 22, 2012. The entire disclosure of each of the above applications is incorporated herein by reference.

The invention relates to a pump, in particular a vacuum pump for brake boosting in a motor vehicle, having a housing, in which a rotor bearing is arranged, in which a rotor is mounted rotatably, the rotor having an oil riser groove in the region of the rotor bearing for supplying the vacuum pump with lubricating oil.

BACKGROUND

Pumps of this type are known.

Vacuum pumps of the abovementioned type can be flange-connected, for example, to the cylinder head of an internal combustion engine. They are then driven by the camshaft of the internal combustion engine. The connection between the camshaft and the rotor of the vacuum pump is produced by way of a coupling, in particular a plug-in coupling. Pumps of this type have oil feed apparatuses, in which the lubricating oil supply of the internal combustion engine is brought into connection with the internal lubricating oil supply of the vacuum pumps by way of oil feed connections in the rotor. It is known to arrange the oil feed connections in such a way that the surfaces which make contact with one another, for example the interfaces between the rotor and the plug-in coupling, are likewise connected to the lubricating oil supply. It is customary to lubricate the interface between the plug-in coupling and the camshaft by way of the oil mist which prevails in the interior space of the cylinder head of the internal combustion engine. However, installation situations are also known, in which no oil mist or insufficient oil mist is available, in order to supply the plug-in coupling with a sufficient quantity of lubricating oil. Plug-in couplings are also known which are partially enclosed by a circumferential wall which is, for example, cylindrical and therefore prevent the oil mist from penetrating from the outside. Plug-in couplings of the abovementioned type are intended to compensate for any existing installation tolerances and can therefore have considerable force and movement changes. An insufficient supply with lubricating oil can therefore lead to considerable wear and to the failure of the vacuum pump.

SUMMARY

It is therefore an object of the invention to provide a pump which solves this problem.

The object of the invention is achieved by way of a pump, in particular a vacuum pump for brake boosting in a motor vehicle, having a housing, a rotor which is mounted rotatably therein, at least one oil riser groove which is arranged in the housing in the region of a rotor bearing section of the rotor, and a transverse bore which is arranged in the rotor bearing section transversely with respect to the longitudinal axis of the rotor and can be connected to the at least one oil riser groove, the rotor bearing section being connected to an oil feed bore, and the at least one transverse bore interacting with an axial bore in the rotor bearing section, which axial bore leads to a coupling section of the rotor, in which coupling section a coupling is arranged and can be engaged by means of a fastening means with a central bore which runs parallel to the longitudinal axis of the rotor. This arrangement has the advantage that in each case only a part quantity of the prevailing oil volume is introduced into the transverse bore and is conveyed through the central bore in the fastening means into the region of the coupling.

In a further particularly preferred embodiment of the invention, the rotor bearing section of the rotor has a transverse bore which is configured to run as far as the longitudinal axis of the rotor. This achieves a situation where the oil riser groove is swept over only once per revolution of the rotor and a minimum quantity of the engine oil is used for the lubrication of the coupling. This ensures that sufficient oil nevertheless passes into the pump.

In another embodiment of the invention, the rotor bearing section of the rotor has a transverse bore which runs all the way through. This causes the oil riser groove to be swept over twice per revolution of the rotor. As a result, the time between the loadings of the coupling with engine oil is reduced and the lubricant feed is increased.

In a further preferred embodiment of the invention, the oil riser groove is connected continuously to the pump interior space. This results in a direct connection of the engine oil supply via the oil feed bore into the rotor bearing section and from there via the oil riser groove into the internal lubrication region of the vacuum pump. Here, the rotor bearing section is ideally configured as a plain bearing and has at least one annular groove on the circumferential face, which annular groove serves for improved supply of the plain bearing with lubricating oil. It has proven advantageous if the oil feed bore opens into the rotor bearing section in the region of the radial groove. As a result, firstly a particularly satisfactory lubricant supply is achieved and secondly the majority of the lubricating oil volume of the internal combustion engine is utilized for the internal lubrication region of the vacuum pump.

A further advantage of the invention is the low pressure pulsation during oil feed into the vacuum pump. The pressure pulsation which is described in the prior art is generated by what are known as discharge jolts. Discharge jolts are produced when the oil path is opened or closed. This happens when a transverse bore is used for intermittent oiling of the pump interior space and therefore has to transport the greatest part quantity of lubricating oil. In such pumps, the lubricating oil pressure of the internal combustion engine namely acts briefly in a defined rotor position as far as into the interior lubrication region of the vacuum pump, which can lead to corresponding pressure pulsations and discharge jolts during ending of the lubricating oil feed depending on the lubricating oil pressure of the internal combustion engine. In the embodiment according to the invention, the transverse bore transports only a small part quantity of the lubricating oil, since the greatest part flows into the pump interior space. As a result of this method of operation, the discharge jolts are not additionally reinforced by the large chamber volume of the vacuum pump, since the latter is oiled continuously. The discharge jolts which are caused by the small part quantity for intermittent oiling of the coupling section are negligibly small.

The part quantity which is branched off in each case from the engine oil quantity must not be too large, or else there is the risk that the pump is under-supplied and the oiling of the coupling is too pronounced. The delivery volume is determined by the angle which the transverse bore passes through during rotation of the rotor. The angle results from the width of the oil riser groove. As an alternative or in addition, the delivery volume can be determined by the bore diameter of the transverse bore and the size of the bevel of the transverse bore. Furthermore, the delivery quantity is also determined by the diameter of the oil feed bore and ultimately also by the engine oil pressure.

The configuration according to the invention of the vacuum pump results, moreover, in the advantage that, in contrast to the known oiling principles, the engine-specific switch-off positions of the internal combustion engine do not have to be taken into consideration, in order to avoid an open oil feed when the engine is at a standstill, since, as a result of using the fastening means which has the central through bore, the latter acts like a throttle and allows air to flow via the short bearing length and the bearing gap into the pump.

DRAWINGS

Figure 2:
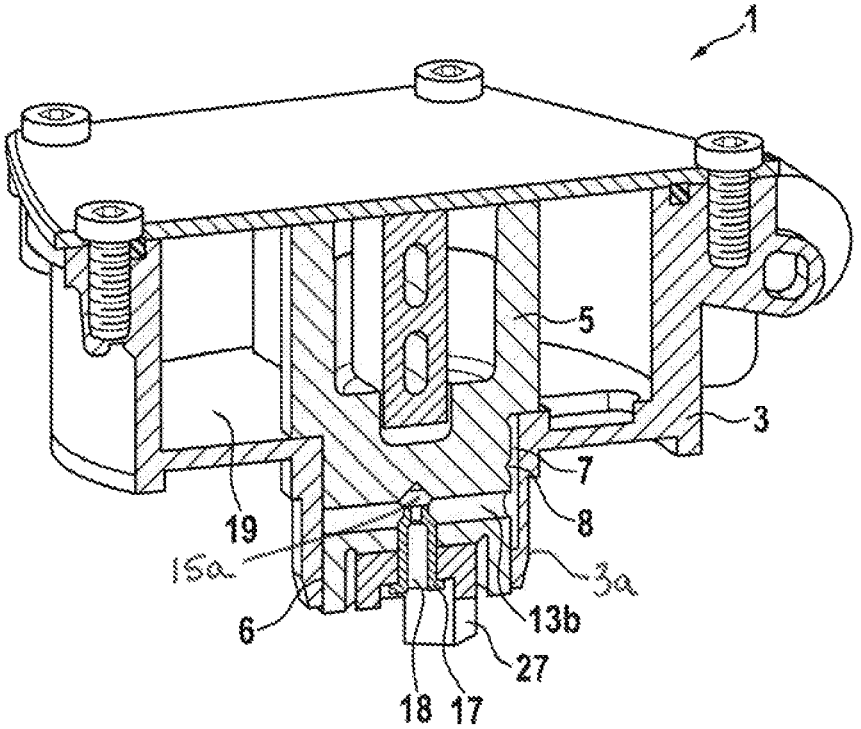
Figure 3C:
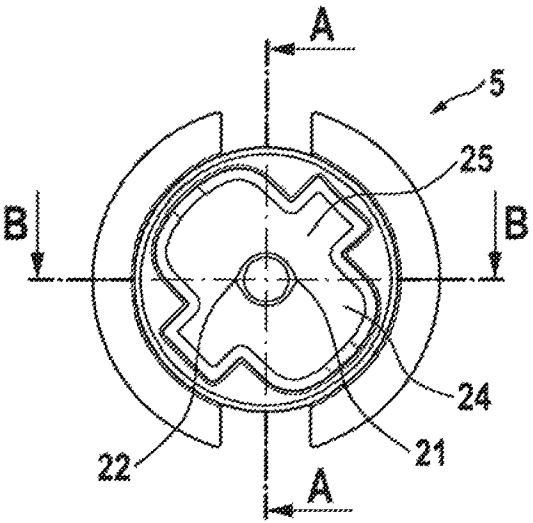
Figure 3A:
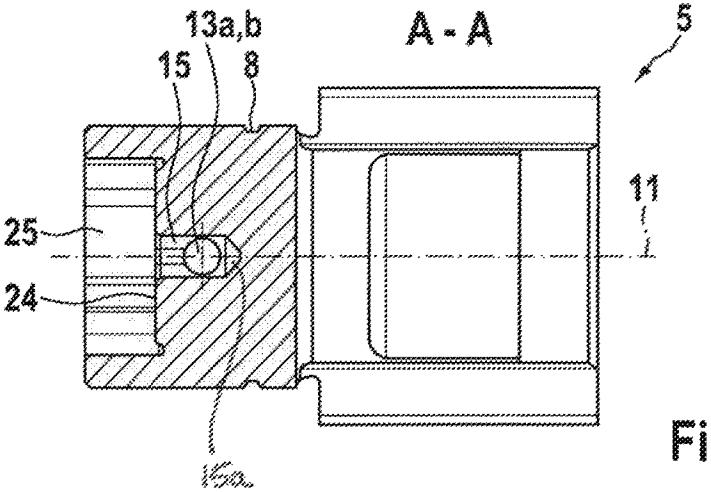
Figure 3B:
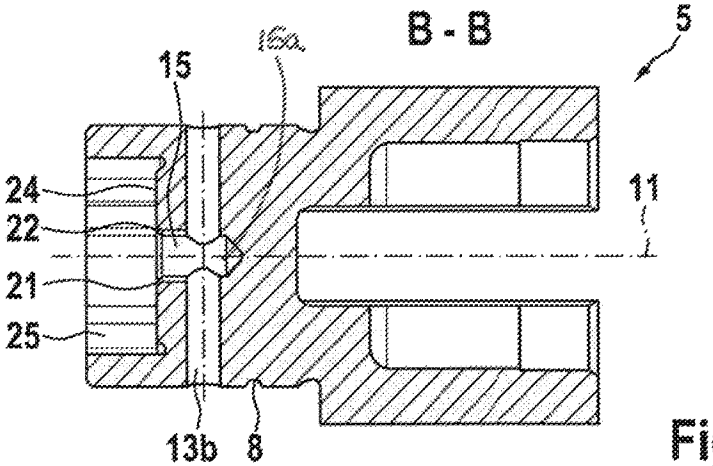

The invention will now be described using one exemplary embodiment which is shown in FIGS. 1 to 3, in which:

FIG. 1 shows a cross section through the vacuum pump according to the invention with the illustration of the oil feed bore, and with the oil feed bore connected to a schematically illustrated internal combustion engine with an engine oil supply and an engine oil circuit, FIG. 2 shows a cross section of the vacuum pump according to the invention with an illustration of the transverse bore and the position of the oil riser groove, FIG. 3*a* shows a first section A-A through the rotor according to the invention, FIG. 3*b* shows a second section B-B through the rotor according to the invention, and FIG. 3*c* shows a plan view of the coupling side of the rotor.

DETAILED DESCRIPTION

FIG. 1 shows a vacuum pump 1 with a rotor 5 having a rotor bearing section 6 rotatably supported in a bearing portion 3*a* of a housing 3. An oil feed bore 9 is arranged in the housing 3 of the pump 1, which oil feed bore 9 is connected to a supply connector 10 and opens into the rotor bearing section 6. The rotor 5 has at least one radial groove 8 which serves for improved distribution of the lubricating oil which is introduced through the oil feed bore 9. The oil feed bore 9 ideally opens into the rotor bearing section 6 in the region of the radial groove 8, in order to achieve an optimum lubricating oil supply. Moreover, the rotor 5 has a transverse bore 13*a* which is configured to run as far as the middle of the rotor bearing section 6. A bore 15 is provided in the axial direction of the rotor 5, into which bore 15 a fastening means 17 is installed for connecting a coupling 27 to the rotor 5. Bore 15 terminates in a conical cavity 15*a*. The fastening means 17 likewise has a central bore 18 in the axial direction. As a result of the rotational movement of the rotor 5, the transverse bore 13*a* sweeps over an oil riser groove 7 formed in housing 3 once per revolution. In this way, a part quantity of the engine oil introduced via supply connector 10 and oil feed bore 9 is removed and is guided through transverse bore 13*a*, bore cavity 15*a* and the central bore 18 of the fastening means 17 into a rotor coupling section 25 of the rotor 5 which is shown in FIG. 3. In this way, oiling of an underside 24 of the rotor coupling section 25 which is likewise shown in FIG. 3 and also of the coupling 27 takes place.

FIG. 2 shows a different view of the vacuum pump 1 according to the invention with a transverse bore 13*b* in the rotor bearing section 6 of the rotor 5, which transverse bore 13*b* reaches over the entire diameter of the rotor bearing section 6. Furthermore, FIG. 2 shows the oil riser groove 7 formed in housing 3 which extends axially in the rotor bearing section 6 as far as into the pump interior space 19. The oil riser groove 7 can be manufactured by means of a material-removing production method, such as milling or drilling. As an alternative, the oil riser groove 7 can also be produced by way of a primary forming method. The final shape then arises from the subsequent final machining. This results in a cross section which is dependent on the production method and can be, for example, rectangular or semi-circular.

It can be seen from the consideration of FIGS. 1 and 2 that there is an uninterrupted connection to the pump interior space 19 starting from the supply connector 10 via the oil feed bore 9, the radial groove 8 and the oil riser groove 7, and continuous oiling of the pump interior space 19 therefore takes place via the lubricating oil pressure of the internal combustion engine. On account of the fact that the rotor bearing section 6 of the rotor 5 of the exemplary embodiment which is shown in FIG. 2 has a transverse bore 13*b* which runs all the way through, the transverse bore 13*b* sweeps over the oil riser groove 7 twice per revolution of the rotor 5. As a result, twice the quantity of engine oil per rotor revolution is delivered into the coupling section 25 of the rotor 5 which can be seen in FIG. 3.

The oil quantity which is to be used for oiling the coupling section 25 of the rotor 5 which is shown in FIGS. 3*a* to 3*c* can additionally be varied by way of further parameter variables such as the diameter of the transverse bore 13, the width and depth of the oil riser groove 7, the cross section of the oil feed bore 9 and engine oil pressure in addition to the structural configuration of the transverse bore (ending in the middle or running all the way through) and can therefore be adapted to the required properties.

The abovementioned low pressure pulsation during oil feed into the vacuum pump 1 results from the fact that the oil flow which is guided via the supply connector 10 and the oil feed bore 9 into the rotor bearing section 6 can pass as it were unimpeded via the oil riser groove 7 into the pump interior space 19. In the embodiment according to the invention, the transverse bore 13*a* or 13*b* transports only a small part quantity of the lubricating oil, since the greatest part flows into the pump interior space 19. As a result of this method of operation, the discharge jolts are not additionally reinforced by way of the large chamber volume of the pump interior space 19 of the vacuum pump 1, since oiling is carried out continuously. The discharge jolts which are caused by way of the small part quantity for intermittent oiling of the coupling section 25 of the rotor 5 are negligibly small.

In the embodiment according to the invention of the vacuum pump 1 according to FIGS. 1 and 2, there is a continuous connection from the engine oil circuit 32 via the supply connector 10 and the oil feed bore 9, via the radial groove 8 and the oil riser groove 7 into the pump interior space 19. The bearing tolerances here result in the formation of a gap which makes rapid ventilating of the pump during switching off of the engine possible. As a result of the formation of a gap at the interfaces, the lubricating grooves 21 and 22 of the rotor 5 which is shown in FIGS. 3*a* to 3*c* and via the transverse bore 13*a* and 13*b* and the oil riser groove 7 of the vacuum pump 1 which is shown in FIGS. 1 and 2, said vacuum pump 1 is ventilated from the outside. This has the advantage that the remaining vacuum in the vacuum pump 1 is dissipated during switching off of the internal combustion engine 29 and therefore when the vacuum pump 1 is at a standstill and therefore no oil is sucked into said vacuum pump 1, which oil would have to be displaced with great effort during restarting and can lead to overloading and to destruction of the vacuum pump 1.

LIST OF DESIGNATIONS

1 Pump
3 Housing
5 Rotor
6 Rotor bearing section
7 Oil riser groove
8 Radial groove
9 Oil feed bore
10 Supply connector
11 Longitudinal axis
13 Transverse bore
15 Axial bore
17 Fastening means
18 Oil bore
19 Pump interior space
21 Lubricating groove
22 Lubricating groove
24 Coupling underside
25 Rotor Coupling section
27 Coupling
29 Internal combustion engine
30 Engine oil supply
32 Engine oil circuit

The invention claimed is:

1. A vacuum pump for brake boosting in a motor vehicle, having a housing, a rotor which is mounted rotatably therein, at least one oil riser groove formed in the housing in the region of a rotor bearing section of the rotor, and a transverse bore which is arranged in the rotor bearing section transversely with respect to a longitudinal axis of the rotor and which is connected to the at least one oil riser groove, the rotor bearing section being connected to an oil feed bore formed in the housing, wherein the transverse bore interacts with an axial bore in the rotor bearing section, which the axial bore leads to a rotor coupling section of the rotor, in which rotor coupling section a coupling is arranged and engaged by a fastening means having a central bore which runs parallel to the longitudinal axis of the rotor for guiding oil from the oil feed bore to the rotor coupling section of the rotor through the transverse bore, the axial bore and the central bore of the fastening means.

2. The pump as claimed in claim 1, wherein the transverse bore is configured to run as far as the middle of the rotor bearing section of the rotor.

3. The pump as claimed in claim 1, wherein the transverse bore is configured to run all the way through the rotor bearing section of the rotor.

4. The pump as claimed in claim 1, wherein the oil feed bore is adapted to be connected to an engine oil circuit of an internal combustion engine.

5. The pump as claimed in claim 1, wherein the rotor includes a radial groove, and wherein the oil feed bore opens into the rotor bearing section of the rotor in the region of the radial groove.

6. The pump as claimed in claim 5, wherein the oil riser groove is connected to a pump interior space and via the radial groove to the oil feed bore.

7. The pump as claimed in claim 1, wherein the pump is ventilated via grooves formed in the rotor bearing section of the rotor.

8. The pump as claimed in claim 1, wherein a volume delivered via the transverse bore and one or more lubricating grooves into the rotor coupling section is determined based on the width of the oil riser groove.

9. A vacuum pump for use in a motor vehicle, comprising:

a housing defining a pump interior space and having a bearing portion that is connected to an oil feed bore, wherein the bearing portion of the housing is formed to include at least one oil riser groove;

a rotor disposed for rotation in the housing about a longitudinal rotary axis, the rotor having a rotor section disposed in the pump interior space of the housing, a rotor bearing section disposed in the bearing portion of the housing, a rotor coupling section formed at an end of the rotor bearing section, an axial bore extending from the rotor coupling section into the rotor bearing section and which is aligned with the longitudinal axis, and a transverse bore communicating with the axial bore and which communicates with the at least one oil riser groove in response to rotation of the rotor;

a coupling installed in the rotor coupling section of the rotor and having a throughbore aligned with the axial bore formed in the rotor bearing section of the rotor; and a fastener extending through the throughbore in the coupling and into the axial bore in the rotor bearing section for securing the coupling to the rotor, the fastener having a central bore aligned with the longitudinal axis of the rotor and which is in communication with the transverse bore formed in the rotor bearing section of the rotor for guiding oil from the oil feed bore to the rotor coupling section of the rotor through the transverse bore, the axial bore and the central bore of the fastener.

10. The vacuum pump as claimed in claim 9, wherein the transverse bore is configured to sweep over the at least one oil riser groove once per revolution of the rotor.

11. The vacuum pump as claimed in claim 9, wherein the transverse bore is configured to sweep over the at least one oil riser groove twice per revolution of the rotor.

12. The vacuum pump as claimed in claim 9, wherein the oil feed bore is formed in the housing, and wherein an engine oil supply from an engine oil circuit is supplied through the oil feed bore to the at least one oil riser groove.

13. The vacuum pump as claimed in claim 12, wherein the at least one oil riser groove communicates with the pump interior space of the housing.

14. The vacuum pump as claimed in claim 12, wherein the oil feed bore opens into a rotor bearing interface between the bearing portion of the housing and the rotor bearing section of the rotor, wherein a radial groove is formed in the rotor bearing section of the rotor which is generally aligned with the oil feed bore and assists in distributing the engine oil supply to the rotor bearing interface and the at least one oil riser groove, and wherein the oil riser grooves supplies a majority of the engine oil supply to the pump interior region while a small portion of the engine oil supply is routed through the transverse bore and the central bore in the fastener into the coupling.

15. The vacuum pump as claimed in claim 14, wherein the axial bore formed in the rotor bearing section of the rotor includes at least one lubrication groove for conveying oil into the rotor coupling section of the rotor.

16. A vacuum pump for brake boosting in a motor vehicle, comprising:

a housing including a bearing portion connected to an oil feed bore and having an oil riser groove;

a rotor having a rotor bearing section rotatably mounted in the bearing portion of the housing for rotation about a longitudinal axis, the rotor bearing section having a transverse bore oriented transversely to the longitudinal bore and which communicates with the oil riser groove in response to rotation of the rotor, wherein the transverse bore interacts with an axial bore formed in the rotor bearing section and which leads to a rotor coupling section of the rotor;

a coupling drivingly engaged with the rotor coupling section of the rotor; and a fastener retained in the axial bore for securing the coupling to the rotor coupling section of the rotor, the fastener having a central bore communicating with the transverse bore for guiding oil from the oil feed bore to the rotor coupling section of the rotor through the transverse bore, the axial bore and the central bore of the fastener.

* * * * *